United States Patent [19]

Yoo et al.

[11] Patent Number: 5,046,584

[45] **Date of Patent: * Sep. 10, 1991**

[54] ELEVATOR OCCUPANT LOAD WEIGHING SENSOR MOUNTING ASSEMBLY

[75] Inventors: Young S. Yoo, Avon; John K. Salmon, South Windsor, both of Conn.

[73] Assignee: Otis Elevator Company, Farmington, Conn.

[ * ] Notice: The portion of the term of this patent subsequent to Jan. 22, 2008, has been disclaimed.

[21] Appl. No.: 582,276

[22] Filed: Sep. 13, 1990

[51] Int. Cl.[5] ..... B66B 5/14

[52] U.S. Cl. ..... 187/1 R; 73/862.54; 177/147

[58] Field of Search ..... 187/1 R, 106, 130, 131; 73/862.54, 862.56, 862.65; 177/132, 147

[56] References Cited

U.S. PATENT DOCUMENTS

| | | | |
|---|---|---|---|
| 2,820,624 | 1/1958 | Koegel | 73/862.56 |
| 3,237,450 | 3/1966 | Brooks | 73/862.65 |
| 4,330,836 | 5/1982 | Donofrio et al. | 364/567 |
| 4,601,356 | 7/1986 | Muccillo | 177/132 X |
| 4,899,852 | 2/1990 | Salmon et al. | 187/1 R |
| 4,986,391 | 1/1991 | Salmon | 187/1 R |

*Primary Examiner*—Robert P. Olszewski
*Assistant Examiner*—Dean A. Reichard
*Attorney, Agent, or Firm*—Willliam W. Jones

[57] ABSTRACT

An elevator car is mounted on a frame by means of four pendulum rods suspended from the frame and attached to the floor of the car, one rod being disposed at each corner of the car. Load-weighing transducer assemblies are mounted on two diagonally opposed suspension rods to sense the weight of the car, and thereby monitor the number of persons on the elevator. A fixed capacity transducer can be used with a variety of different size and weight cars through the use of a pivot arm mounting assembly for the transducer.

6 Claims, 1 Drawing Sheet

ELEVATOR OCCUPANT LOAD WEIGHING SENSOR MOUNTING ASSEMBLY

TECHNICAL FIELD

This invention relates to an elevator car assembly and more particularly to the sensing of passenger load in an elevator car.

BACKGROUND ART

An important input for an elevator controller relates to the load, or number of passengers, in the elevator car. U.S. Pat. No. 4,330,836 granted May 18, 1982 to A. J. Donofrio, et al., relates to elevator cab load measuring, and contains a discussion of the desirability of monitoring car load, and the enhancement of elevator control derived therefrom. In the system disclosed in this patent, the elevator car is mounted on the frame by means of a plurality of elastomeric damped mount assemblies. There are, for example, six of the mount assemblies, and two of them will be equipped with force transducers which measure the car load.

U.S. Pat. No. 4,899,852 granted Feb. 13, 1990, to us discloses an elevator car mounting assembly wherein the car is suspended on the frame by a plurality of pendulum rods, one at each corner of the car. This patent briefly alludes to a load weighing assembly which is included in the mounting assembly.

Disclosure of the Invention

This invention relates to the preferred embodiment of the load weighing assembly generally disclosed in U.S. Pat. No. 4,899,852. The car is suspended in the frame by four pendulum rods, one at each corner of the car. One diagonally opposed pair of the pendulum rods will be equipped with the load weighing assembly of this invention. This allows for more accurate monitoring of the car load since there are only four load paths, and 50% of them will be monitored. In the prior art, only 33% or less of the load bearing paths were monitored. The load weighing assembly permits a single capacity transducer to be used over a wide range of elevator car weights. In general, the assembly includes a lever which presses on the transducer so that the length of the lever arm acts as a multiplier of the operating range of the load cell transducer.

It is therefore an object of this invention to provide an improved load weighing capability for an elevator car.

It is a further object of this invention to provide an elevator car load weighing assembly which can be used on a suspended car.

It is another object of this invention to provide an elevator car load weighing assembly of the character described which can utilize a common load transducer or load cell on elevator cars of different weights.

These and other objects and advantages of the invention will become more readily apparent from the following detailed description of a preferred embodiment thereof, when taken in conjunction with the accompanying drawings, in which:

BEST MODE FOR CARRYING OUT THE INVENTION

Figure 1:
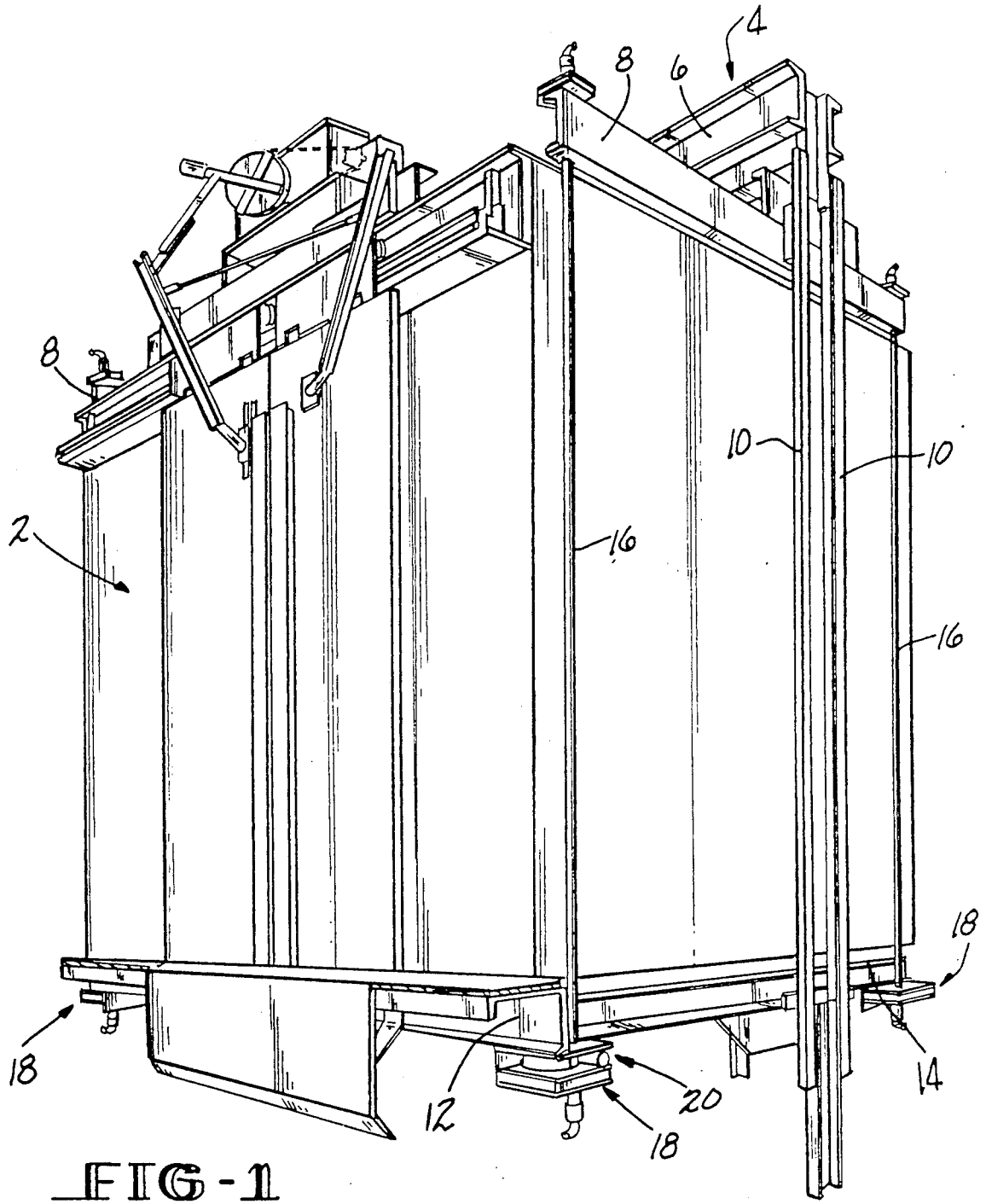
FIG. 1 is a perspective view of an elevator car which is suspended in a car frame by means of pendulum rods located at each corner of the car.

Referring now to FIG. 1, there is shown the elevator car assembly comprising the car 2 and the frame 4. The frame 4 has an upper cross beam 6, upper side beams 8 secured to the cross beam 6, and side vertical stiles 10 (only one set of which is shown) secured to the frame 4 and to the upper side beams 8. The floor of the car 2 includes floor beams 12 and 14. Four rods 16 (two of which are shown) suspend the car 2 in the frame 4 in the pendulum style. The rods 16 are fixed to the upper side beams 8 on the frame 4, and pass through the car floor beams 12 and 14. Support feet 18 are fixed to the lower end of each rod 16 thereby bearing the weight of the car 2 at each corner of the latter. The load sensing assemblies, denoted generally by the numeral 20 are mounted on two diametrically opposed rods 16. In FIG. 1, the load weighing assemblies 20 are shown at the bottom of the rods 16, but they can just as easily be mounted at the top of the rods 16.

Figure 2:
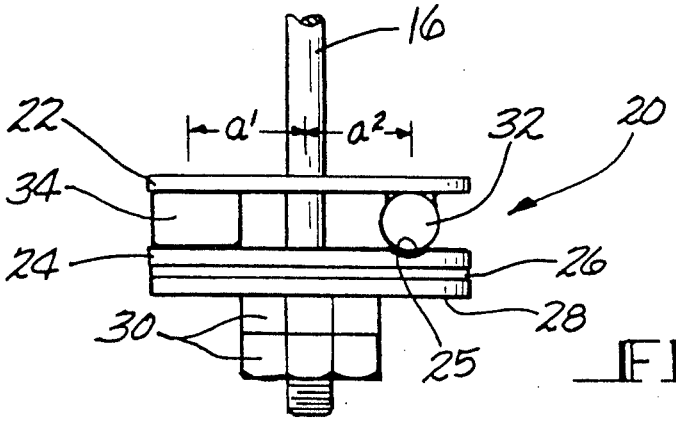
FIG. 2 is a side elevational view of one of the load sensing assemblies.

FIG. 2 shows details of a load weighing assembly 20. The assembly 20 includes upper and lower support plates 22 and 24, respectively, through which the rod 16 passes. A sound isolation pad 26 is disposed below the plate 24, and an end plate 28 is disposed below the pad 26. Lock nuts 30 are threaded onto the lower end of the rod 16 to hold the aforesaid components on the rod 16. As seen in FIG. 1, the upper plate 22 supports the lower car beams 12 and 14. A cylindrical roller 32 is disposed on one side of the rod 16 between the plates 22 and 24, and the load sensing transducer 34 is disposed between the plates 22 and 24 on the other side of the rod 16. The roller 32 may be welded to the plate 22 whereby its axis will be fixed relative to the axis of the rod 16 and it sits in a groove 25 in the plate 24. The load sensing transducer 34 is a conventional device, such as is made by Sensotec Corporation of Columbus, Ohio. With the arrangement shown in FIG. 2, the roller 32 bears some of the load of the car, and the load cell 34 also bears some of the load of the car. The roller 32 can be thought of as a hinge for the plate 22. When the distance $a^1$ between the axis of the load cell 34 and the axis of the rod 16 equals the distance $a^2$ between the axis of the rod 16 and the axis of the roller 32, then the roller 32 and load cell 34 will each bear one half of the tension in the rod 16 resulting from the car 2. In this manner, the force on the load cell can be held within the range in which the load cell is designed to operate. For example, a cell designed for a 1,000 lb. upper working limit can be used to measure tensions up to 2,000 lbs. By moving the load cell 34 farther away from the rod 16 while keeping the roller 32 the same distance from the rod 16, the percentage of rod tension borne by the load cell decreases. For example, a geometry can be selected wherein the roller 32 bears two-thirds of the rod tension, while the load cell 34 bears only one-third of the rod tension. With the latter arrangement, a 1,000 lb. maximum load cell can measure tensions of up to 3,000 lbs.

It will be readily appreciated that the load weighing assembly of this invention can result in allowing one to use a single maximum capacity load cell in load weighing assemblies for a wide range of elevator car weights. By cutting down the load bearing paths in the system, one can accurately monitor car loading with a minimum number of load cells.

Since many changes and variations of the disclosed embodiment of the invention may be made without departing from the inventive concept, it is not intended to limit the invention otherwise than as required by the appended claims.

What is claimed is:

1. An elevator car assembly having improved load weighing capabilities, said assembly comprising:

a. a car assembly frame;

b. an occupant-carrying cab;

c. a plurality of pendulum support rods connecting said cab to said frame, said rods being disposed one at each corner of said cab and having one end connected to said frame and an opposite end connected to said cab whereby said rods are tensioned in proportion with the weight of said cab and its occupants;

d. a load weighing cell assembly mounted on at least one of said rods and operable to measure cab and occupant load at said one of said rods, said cell assembly including a load weighing cell and an associated load support means operable to limit the load imposed upon said cell to a fraction of actual load at said one of said rods.

2. The elevator car assembly of claim 1 wherein said cell and said load support means are each spaced predetermined distances from the axis of said one of said rods on opposite sides thereof, and are disposed on a component of said cell assembly which is fixed relative to said one of said rods, whereby said cell and said load support means share the actual load at said one of said rods.

3. The elevator car assembly of claim 2 wherein said cell and said load support means are spaced from the axis of said one of said rods respective distances operable to impose one-half of said actual load on each of said cell and said load support means.

4. The elevator car assembly of claim 1 wherein there are equivalent load weighing cell assemblies associated with more than one of said support rods.

5. The elevator car assembly of claim 4 wherein there are four support rods, two of which are associated with load weighing cell assemblies.

6. An elevator car assembly having improved load weighing capabilities, said car assembly including a frame and an occupant-carrying cab connected to said frame by four pendulum support rods connected at one end to said frame, and at an opposite end to said car, said support rods being disposed at corners of said cab whereby each support rod supports approximately one-quarter of the load of said car and its occupants; and load weighing assemblies mounted on diagonally opposed support rods, said load weighing assemblies comprising a load cell and auxiliary load support means operable to reduce the load imposed on each load cell to less than one-quarter of the actual prevailing cab and occupant load whereby lower load capacity load cells can be used in said load weighing assemblies.

* * * * *